United States Patent [19]

Lang et al.

[11] Patent Number: 4,719,811

[45] Date of Patent: Jan. 19, 1988

[54] WELL PUMPING UNIT WITH COUNTERWEIGHT

[75] Inventors: Jerry M. Lang, Lindale; Gordon R. Lively, Longview, both of Tex.

[73] Assignee: Rota-Flex Corporation, Longview, Tex.

[21] Appl. No.: 704,924

[22] Filed: Feb. 25, 1985

[51] Int. Cl.[4] ..... F04B 47/02; F16H 19/06

[52] U.S. Cl. ..... 74/89.22; 187/94; 254/338

[58] Field of Search ..... 74/89.2, 89.21, 89.22; 187/15, 70, 94; 254/286, 338

[56] References Cited

U.S. PATENT DOCUMENTS

| | | | |
|---|---|---|---|
| 146,699 | 1/1874 | Moore | 187/94 |
| 974,447 | 11/1910 | Sundh | 187/94 |
| 2,370,029 | 2/1945 | Gillespie | 74/89.2 |
| 2,681,623 | 6/1954 | Kane | 92/137 |
| 2,683,424 | 7/1954 | Kane | 92/137 |
| 2,926,000 | 2/1960 | Allen | 254/173 |
| 3,153,387 | 10/1964 | Sadouet | 74/41 |
| 3,248,958 | 5/1966 | Bender | 74/89.2 |
| 3,285,081 | 11/1966 | Kuhns et al. | 74/89.22 |
| 3,528,305 | 9/1970 | Kuhns et al. | 74/89.22 |
| 3,695,117 | 10/1972 | Ewing et al. | 74/89.22 |
| 4,052,907 | 10/1977 | Chardonneau et al. | 74/89.22 |
| 4,391,155 | 7/1983 | Bender | 74/89.2 |
| 4,519,262 | 5/1985 | Le et al. | 74/89.2 |

FOREIGN PATENT DOCUMENTS

| | | | |
|---|---|---|---|
| 664686 | 1/1952 | United Kingdom | 254/338 |
| 753769 | 8/1980 | U.S.S.R. | 187/94 |

*Primary Examiner*—Lawrence Staab

*Attorney, Agent, or Firm*—Roylance, Abrams, Berdo & Goodman

[57] ABSTRACT

A well pumping unit including a derrick having first and second sheave sets attached near the top thereof, a drive mechanism, a counterweight, a polish rod assembly and cable members. The cable members form a closed loop extending from the polish rod assembly to the first sheave set, to the counterweight, to the second sheave set, to the drive mechanism, to the second sheave set, to the first sheave set and back to the polish rod assembly. The counterweight is suspended by the sheave sets and cable members between the sheave sets. When the drive mechanism operates in a first direction, the polish rod assembly is raised and the counterweight lowered. When the drive mechanism operates in a second direction, the counterweight is raised and the polish rod assembly lowered. The counterweight may be located within the derrick while the polish rod assembly and drive mechanism may be located outside of the derrick. The weight of the counterweight may be adjusted as desired.

18 Claims, 5 Drawing Figures

WELL PUMPING UNIT WITH COUNTERWEIGHT

FIELD OF THE INVENTION

This invention relates to well pumping units for pumping fluids from beneath the earth's surface to or above the earth's surface using polish and sucker rods. More particularly, this invention relates to such units which include a counterweight to balance the weight of the polish and sucker rods during the pumping action.

BACKGROUND OF THE INVENTION

Well pumping units are employed to pump fluids which are located beneath the surface of the earth to a position at or above the earth's surface. Access to the underground fluids is usually gained by drilling a hole through the earth's crust until the underground reservoir or deposit of fluid is reached. Then casing is lowered into the drill hole until the casing extends from the underground fluid reservoir up to the earth's surface. A pumping unit, including a polish rod and a sucker rod, is then employed with tubing located inside the casing to pump the fluids upward from the underground fluid reservoir to the earth's surface.

These well pumping units may be employed to pump any type of fluid, including water, natural gas, crude oil, etc. Since a common application of such well pumping units is to pump crude oil from an underground reservoir to the earth's surface, this invention will be discussed in that environment without limiting the scope of the invention solely to that environment.

As our crude oil resources become depleted, it becomes necessary to drill deeper for new crude oil sources and to pump this oil from a greater distance below the earth's surface and for long periods of time to accomplish what is known as secondary recovery from old wells. For secondary recovery, it is highly advantageous to provide a pumping unit with a long, slow stroke which results in longer pump and rod life and more efficient pumping, while limiting torque in the system and the size of its supporting structure. The deeper the well, the greater the force is needed to run conventional drive mechanisms and pumping units. Some of these conventional well pumping units are very inefficient when used in deep wells and may in fact be inoperable in very deep wells.

These well pumping units include a polish rod and a sucker rod within tubing which extends down through the well casing or pipe into the underground fluid reservoir. The sucker rod is attached to the lowermost end of the polish rod. The polish rod extends from the sucker rod to above the earth's surface. The polish and sucker rods are raised and lowered within the drill hole by a reciprocating drive mechanism. Usually, the reciprocating drive mechanism is connected to the polish rod by a cable. When the reciprocating drive mechanism moves in a first direction, it pulls the polish and sucker rods upward via the cable. When the drive mechanism moves in the second direction, it releases the cable and the gravity force on the polish and sucker rods takes up any slack in the cable and pulls the polish and sucker rods down the length of cable which has been released.

These well pumping units also include a derrick, boom or similar structure positioned above the drill hole and well pipe. This derrick typically supports the polish and sucker rods and any other apparatus associated therewith.

As stated above, these conventional well pumps have been unsatisfactory, particularly when employed with relatively deep wells, since the drive mechanisms when rotated in the first direction must have enough energy to lift the entire polish and sucker rod assembly and any liquid being pumped thereby. Then when the polish rod assembly is in the down cycle, the pumps rely solely on the force of gravity to drive the polish and sucker rods downward within the drill hole.

To overcome the problems associated with these pumping units of having the drive mechanism lift the entire weight of the polish and sucker rod assembly and associated fluids, well pumping units have been provided with a counterweight that somewhat offsets the weight of the polish and sucker rods so that the drive mechanism does not have to lift the entire weight of the polish and sucker rod assembly. In these systems, the counterweight is positioned so its weight opposes the weight of the polish and sucker rods as the polish and sucker rods are lifted. These counterweight well pumping units are of two basic types.

In the first type, a cable is attached to the top of the polish and sucker rods and extends to the drive mechanism. Also attached to the drive mechanism is a cable which connects the counterweight to the drive mechanism. The cables are attached to the drive mechanism such that the cables "pull" in opposite directions on the drive mechanism. The weight of the counterweight opposes the weight of the polish and sucker rods and fluid being pumped thereby when the polish rod assembly is being raised. Thus, the drive mechanism only has to raise the weight of the polish and sucker rods and associated fluid minus the weight of the counterweight. Examples of this type of pumping unit are disclosed in U.S. Pat. Nos. 2,370,029 to Gillespie; 2,681,623 to Kane; 2,683,424 to Kane; 3,285,081 to Kuhns et al; 3,528,305 to Kuhns et al; 3,695,117 to Ewing et al and 4,052,907 to Chardonneau et al.

The second general type of prior well pumping units with counterweights include the counterweight in the cable line between the polish rod and the drive mechanism. In these units, a cable extends from the top of the polish rod over a sheave located near the top of the derrick, to a counterweight and then to the drive mechanism. The counterweight is suspended on the opposite side of the sheave from the polish rod assembly so that the counterweight offsets the weight of the polish rod assembly. The weight of the polish and sucker rod assembly is partially negated by the counterweight before the weight is transmitted to the drive mechanism. Examples of this type of pumping unit are disclosed in U.S. Pat. Nos. 2,926,000 to Allen; 3,248,958 to Bender; 3,153,387 to Sadouet and 4,391,155 to Bender.

In these well pumping units, the drive mechanism must only provide enough energy to lift the weight differential between (1) the polish and sucker rod assemblies and fluids being pumped thereby and (2) the counterweight. However, when the polish rod assembly is in the down cycle, the counterweight opposes the downward movement of the polish rod assembly and reduces the gravitational pull forcing the polish rod assembly downward to the difference in the weight between the polish and sucker rod assembly and the counterweight.

The disadvantages of these prior well pumping units with counterweight systems are many. First, the polish and sucker rod assembly must always be heavier than the counterweight or else the entire system will fail since the units rely on the gravitational force on the polish and sucker rod assembly to drive these assemblies downward. If the counterweight is made equal in weight to or greater in weight than the polish and sucker rod, then the system will come to a complete standstill.

Second, the drive mechanism must still provide a force equal to the difference between the (1) polish and sucker rod assembly and associated fluid and (2) the counterweight. For deep wells, this difference in weight may be extremely high, making it necessary to have a very powerful drive mechanism.

For those embodiments which involve the counterweight on the opposite side of the drive mechanism from the polish rod assembly, these systems also include the disadvantage that all forces pull on the drive mechanism. This renders the drive mechanism less durable and it requires that the drive mechanisms be built to withstand large forces. The counterweight in these units does not directly balance the polish and sucker rod assembly, because all forces must be balanced through the drive mechanism.

SUMMARY OF THE INVENTION

From the above, it is apparent that there exists a need in the art for a durable well pumping unit which requires a minimum amount of energy to effectively pump the fluids to the earth's surface. This invention fulfills this need in the art, along with many other needs which will become apparent to those skilled in the art once given this disclosure.

Generally speaking, this invention provides a well pumping unit comprising a derrick; a polish rod assembly; a drive mechanism for operating the well pumping unit; a counterweight; first and second sheaves which are rotatably connected to the derrick near the top of the derrick in a spaced relationship; and, cable members for connecting the drive mechanism, the polish rod assembly and the counterweight; the cable members engaging the sheaves; the counterweights being suspended by the cable members between the sheaves; the cable members extending from the drive mechanism to the polish rod assembly to the first sheave to the counterweight; the cable members also extending from the drive mechanism to the second sheave to the counterweight.

In some embodiments, the cable members form a closed loop which extends from the polish rod assembly to the first sheave, to the counterweight, to the second sheave, to the drive mechanism, to the second sheave, to the first sheave and back to the polish rod.

In other embodiments, the polish rod assembly is located on a first side of the derrick, the counterweight is located within the derrick and the driving mechanism is located on a second side of the derrick. The counterweight moves up and down within the derrick as the well pumping unit is operated.

In yet other embodiments, the drive mechanism is a reciprocating mechanism which as it rotates in a first direction lifts the polish rod assembly and when it rotates in a second direction, lifts the counterweight, thus lowering the polish rod assembly. The cable members may be affixably attached to the drive mechanism.

Well pumping units according to this invention have many advantages over the prior well pumping units, including the prior well pumping units with counterweights. First, the well pumping units according to this invention will operate regardless of the relative weights between the counterweight and the polish rod assembly and fluid associated therewith. Unlike the prior well pumping units with counterweights which would not function if the counterweight outweighed the polish rod assembly, the well pumping units according to this invention will function whether the counterweight weighs less than, equal to or greater than the polish rod assembly.

A further advantage of this invention is that it provides a more durable well pumping unit. Due to the balancing of the polish rod assembly and counterweight forces and the fact that the forces are balanced prior to the application of these forces to the drive mechanism, there is less wear and tear on the parts of a well pumping unit according to this invention as compared to the prior well pumping units. The reciprocating drum of the drive mechanism is subjected to less severe forces, as are the cables which engage the drive mechanism.

Yet another advantage of well pumping units according to the subject invention is that, as compared to other well pumping units, less power is required per volume of fluid pumped. In this regard, and as discussed below, if the counterweight and polish rod assembly are of equal weight, then the only weight which must be lifted by the drive mechanism is the weight of the fluid being pumped by the polish rod assembly. To make the well pumping unit even more efficient, the unit can be adjusted so that the counterweight is equal in weight to the weight of the polish rod assembly and one-half of the maximum fluid being lifted by the polish rod assembly.

When the well pumping unit is balanced in this manner, the maximum weight the drive mechanism has to lift is one-half of the fluid weight being lifted by the polish rod assembly. This is achieved since when the polish rod assembly is being lifted, the actual weight being lifted by the drive mechanism is equal to the weight of the polish rod assembly plus the weight of the fluid minus the weight of the counterweight. Since the counterweight is equal to the weight of the polish rod assembly plus one-half the fluid weight, in actuality, the drive mechanism is only lifting one-half of the fluid weight. On the other hand, when the polish rod assembly is being lowered, the actual weight being lifted by the drive mechanism is equal to the weight of the counterweight minus the weight of the polish rod assembly. Since the counterweight is equal to the weight of the polish rod plus one-half of the fluid, the weight being lifted during this portion of the pumping cycle is also equal to one-half of the fluid weight.

A further advantage of pumping units according to this invention is that it is possible to stop the pump during the pumping action with little or no braking. The brakes for the units only have to be applied for safety reasons during servicing of the units.

It is thus an object of this invention to provide a well pumping unit with a counterweight which is more efficient than the prior well pumping units, with and without counterweights.

It is a further object of this invention to provide a well pumping unit which is durable and uses low horsepower, while limiting torque in the system and the size of its supporting structure.

It is a further object of this invention to provide a well pumping unit which is more economical to operate in that a greater volume of fluid can be pumped per unit energy.

It is yet another object of this invention to provide a well pumping unit which provides a maximum flow of fluid and a long, slow pumping stroke.

Certain embodiments of this invention are illustrated in the drawings, wherein:

DETAILED DESCRIPTION OF THE DRAWINGS

Figure 1:
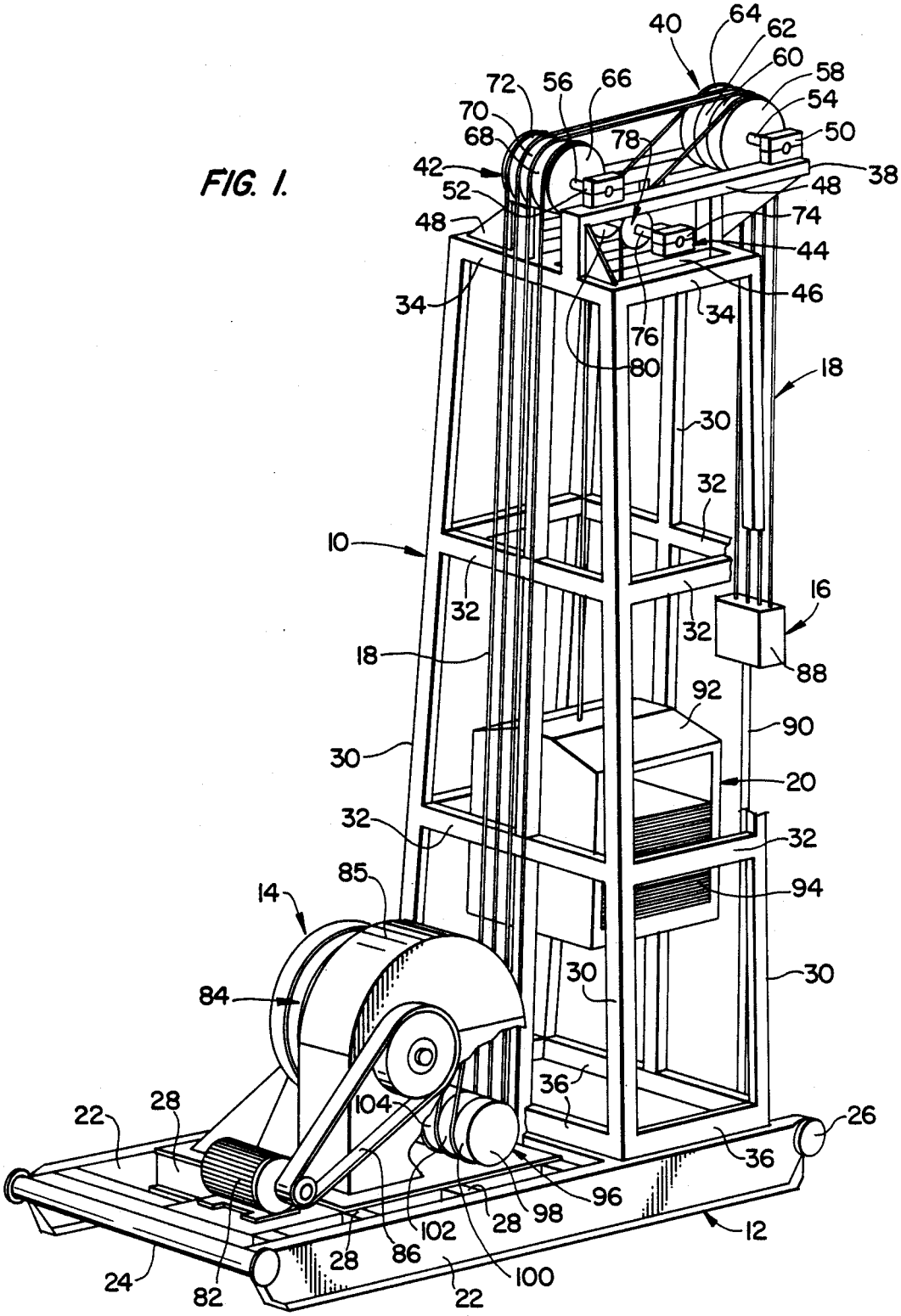
FIG. 1 is a perspective view of one embodiment of this invention.
Figure 5:
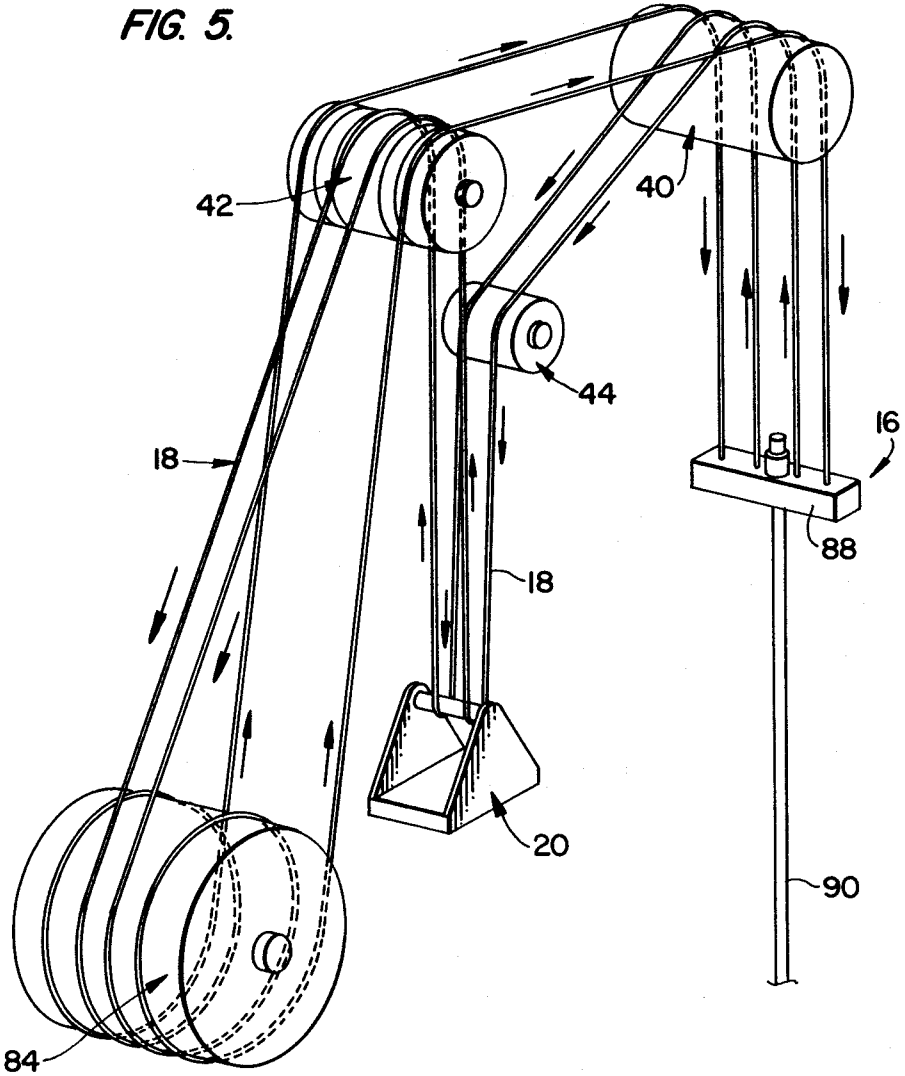
FIG. 5 is further schematic representation of a well pumping unit according to this invention.

Referring to the drawings, and in particular FIGS. 1 and 5, the embodiment of this invention illustrated includes derrick structure 10, sled 12, drive mechanism 14, polish rod assembly 16, cable members 18 and counterweight assembly 20. The embodiment is designed to be employed with a well hole and pipe including upper pipe 21 (see FIGS. 2 and 3).

Sled 12 is comprised of side runners 22, front member 24, rear member 26 and interior beams 28. Front member 24, rear member 26 and interior beams 28 extend laterally between and are connected on their ends to the side runners 22. Members 24 and 26 and beams 28 provide lateral support for the sled 12. Sled 12 is designed such that it can be moved from well hole to well hole as desired. Derrick structure 10 and drive mechanism 14 are mounted on sled 12.

Derrick structure 10 includes vertical columns 30, horizontal beams 32, top cross beams 34, bottom cross beams 36 and sheave assembly 38. Beams 32, 34 and 36 extend between adjacent vertical columns 30 around the perimeter of derrick structure 10, such that derrick structure 10 has a "hollow" interior which receives counterweight 20. A "frame" of horizontal beam 32 is spaced vertically from top and bottom cross beams 34 and 36, as shown in FIG. 1. Bottom cross beams 36 rest on sled 12. Beam 28, 32, 34 and 36 and columns 30 are all steel structural members in the shape of channels, angles and I-beams, etc.

Sheave assembly 38 includes first sheave set 40, second sheave set 42, third sheave set 44, platform 46 and sheave support 48.

Platform 46 is connected to and supported by top cross beams 34. Platform 46 is comprised of a number of wood or metal members spaced edge to edge and has apertures therein for cable members 18 to pass through.

Sheave support 48 is connected to top cross beams 34 and extends upward therefrom. Sheave support 48 includes a pair of identical spaced members which support sheave sets 40 and 42 therebetween.

Sheave sets 40 and 42 include four sheaves (sheaves 58, 60, 62 and 64 in sheave set 40 and sheaves 66, 68, 70 and 72 in sheave set 42), axles 54 and 56 and axle housings 50 and 52, respectively. Axle housings 50 and 52 are in pairs, one of each pair being attached to one of the spaced members of sheave support 48. Each axle end housing 50 and 52 rotatably receives an end of axles 54 and 56, respectively.

Third sheave set 44 includes a pair of spaced axle end housings 74, axle 76 and sheaves 78 and 80. Axle end housings 74 are mounted on platform 46 and rotatably receive the ends of axle 76. Sheaves 78 and 80 are mounted on axle 76.

Drive mechanism 14 is comprised of motor 82, reciprocating drum 84, housing 85, belt 86 and sheave set 90. Motor 82 and reciprocating drum 84 are well known in the art and thus not illustrated in detail. Belt 86 extends between motor 82 and reciprocating drum 84 and drives drum 84 in a reciprocating motion. Sheave set 96 comprises sheaves 98, 100, 102 and 104 which are rotatably received within housing 85.

Polish rod assembly 16 includes top bracket 88, polish rod 90 and a sucker rod (not shown). The sucker rod is attached to the lower end of polish rod 90. Polish rod assembly 16 is designed to slide up and down within the well hole as the pump is operated. This motion pumps oil to the earth's surface.

Counterweight assembly 20 includes housing 92 and leaves 94. Leaves 94 are received within housing 92 such that any number of leaves 94 can be placed within housing 92 to vary the weight of counterweight assembly 20.

As seen in FIGS. 1, 2, 3 and 5, cable members 18 form two closed loops, each loop extending from top bracket 88 of polish rod assembly 16 up to and over one of the sheaves of first sheave set 40, to and over one of the sheaves of third sheave set 44, down to the counterweight housing 92, up to and over one of the sheaves of the second sheave set 42, down and under to the fourth sheave assembly 96, to and around the reciprocating drum 84, back to and under one of the sheaves of the fourth sheave assembly 96, up to and over one of the sheaves of the second sheave set 42, to and over one of the sheaves of first sheave set 40 and back down to top bracket 88 of polish rod assembly 16. Two closed loops are employed for safety reasons, in case one of the cables should break in use. As shown in FIG. 1, the first cable member engages sheaves 58 and 60 of sheave set 40, sheaves 66 and 68 of sheave set 42, sheave 78 of sheave set 44 and sheaves 98 and 100 of sheave set 96. The second cable engages sheaves 62 and 64 of the sheave set 40, sheaves 70 and 72 of sheave set 42, sheave 80 of sheave set 44 and sheaves 102 of sheave set 96. Each of the cables is fixedly attached to reciprocating drum 84 and can be wrapped around drum 84 any desired number of turns. Each of the cables is also fixedly attached to top bracket 88.

Figure 2:
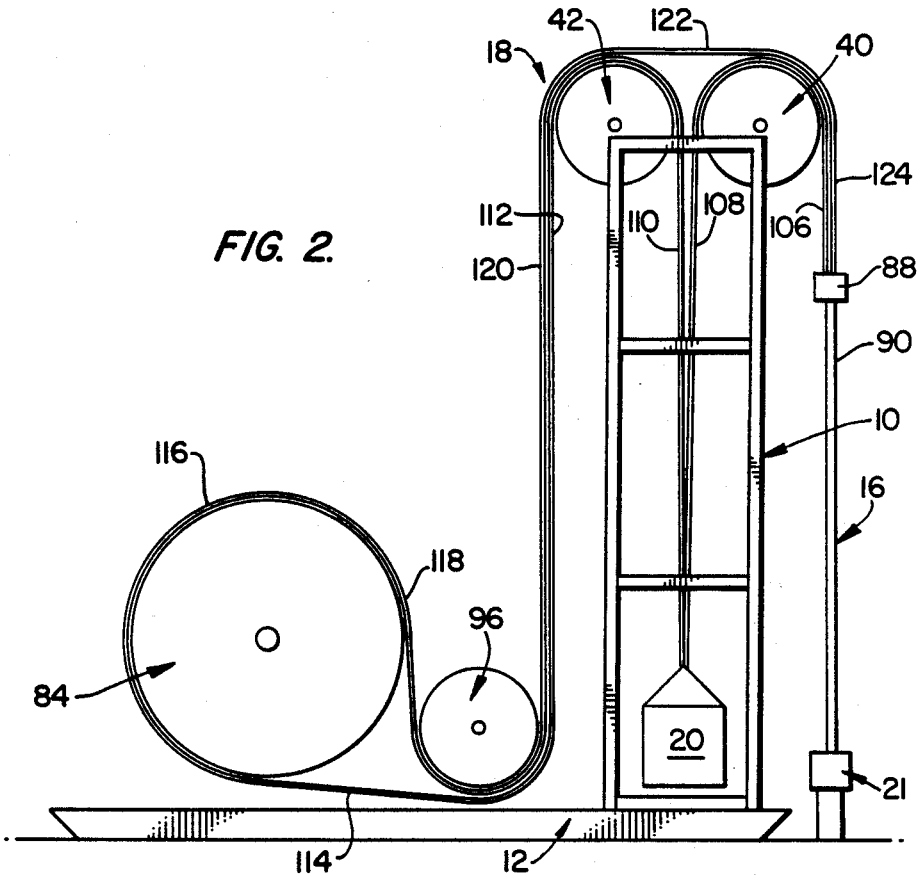
FIG. 2 is a schematic drawing of a well pumping unit according to this invention having the polish rod assembly in its upper position and the counterweight in its lower position.
Figure 3:
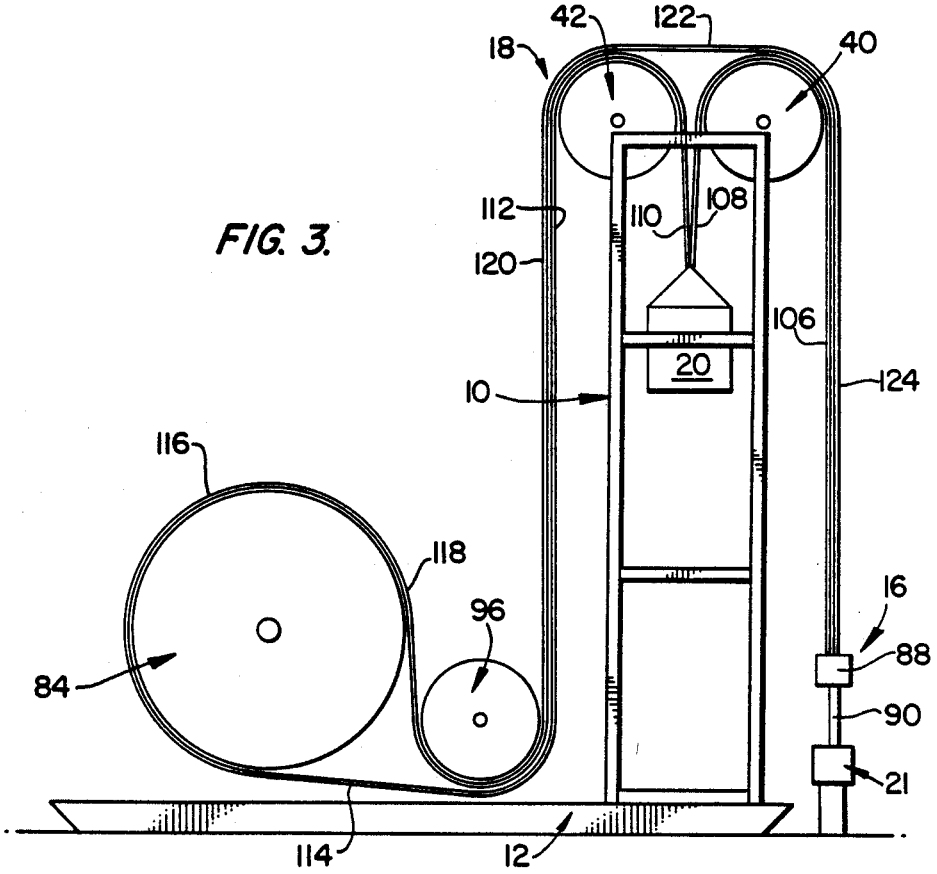
FIG. 3 is a schematic drawing similar to FIG. 2 except that the polish rod is now in its lower position and the counterweight is in its upper position.

Turning to FIGS. 2 and 3, the well pumping unit of FIG. 1 is schematically illustrated omitting third sheave set 44 and motor 82. In these Figures, cable members 18 consist of segments 106 which extend from top bracket 88 of polish rod assembly 16 to first sheave set 40, segments 108 which extend from first sheave set 40 to counterweight assembly 20, segments 110 which extend from counterweight assembly 20 to second sheave set 42, segments 112 which extend from second sheave set 42 to fourth sheave set 96, segments 114 which extend from fourth sheave set 96 to reciprocating drum 84, segments 116 which are wrapped around reciprocating drum 84, segments 118 which extend from reciprocating drum 84 back to fourth sheave set 96, segments 120 which extend from fourth sheave set 96 to second sheave set 42, segments 122 which extend from second sheave set 42 to first sheave set 40 and segments 124 which extend from first sheave set 40 back to the bracket 88 of polish rod assembly 16.

FIG. 2 illustrates polish rod assembly 16 in its uppermost position with counterweight assembly 20 in its lowermost position. FIG. 3 illustrates polish rod assembly 16 in its lowermost position and counterweight assembly 20 in its uppermost position. The pumping unit reciprocates polish rod assembly 16 between these two positions as the pumping unit is operated. This action pumps fluid from the underground reservoir to the earth's surface.

Figure 4:
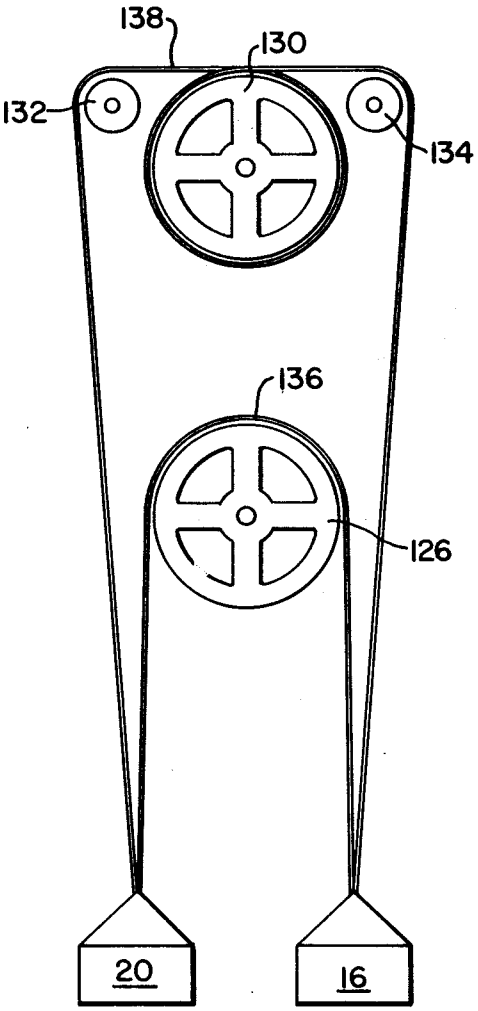
FIG. 4 is a schematic representation of the upper sheaves, cable members, the counterweight and the polish rod assembly.

FIG. 4 is another simplified schematic of the well pumping unit illustrated in FIG. 1, included to illustrate the relative forces involved during the pumping action of the well pumping unit. In FIG. 4, polish rod assembly 16 and counterweight assembly 20 are represented by simple blocks suspended by cable 136 on opposite sides of sheave 126. The sheaving system of the pumping unit is represented by lower sheave 126 and upper sheaves 132 and 134. The drive mechanism is represented by wheel 130. Cable 138 runs from polish rod assembly 16 over sheave 134, to drive wheel 130, to sheave 132 and to counterweight 20. Cables 136 and 138 represent cable members 18.

As seen in FIG. 4, if polish rod assembly 16 and counterweight 20 are of equal weight, then the system will be in perfect balance. Under these conditions, the only force required by drive wheel 130 to operate the pumping unit will be force sufficient to overcome the frictional forces of the system and to provide enough force to lift only the fluid being pumped by polish rod assembly 16, since counterweight 20 negates the weight of polish rod assembly 16. On the other hand, when the polish rod is empty and the counterweight is being lifted, the only energy necessary to operate the system is the energy to overcome the frictional forces in the system, since the polish rod assembly 16 is equal in weight to the counterweight. Stated differently, when the polish rod assembly 16 is being lifted, the drive mechanism must supply sufficient energy to lift only the weight of the fluid being pumped and when the polish rod is lowered (and counterweight is being lifted) the drive mechanism only need provide enough force to overcome the frictional forces in the system.

To further reduce the energy needed to operate the system, counterweight 20 may be adjusted so that its weight is equal to the weight of polish rod 16 plus one half of the weight of the fluid when polish rod assembly 16 is being lifted. When the counterweight 20 is so adjusted, and when the polish rod assembly is being lowered and counterweight 20 is being raised, the energy necessary to operate the system will be equal to one-half the weight of the fluid (the weight of the counterweight [which is equal to the weight of the polish rod assembly plus one-half of the weight of the fluid] minus the weight of the polish rod assembly). Likewise, when the polish rod is being raised, the energy necessary to operate the system is equal to one-half of the fluid weight (the weight of the polish rod assembly and fluid minus the weight of the counterweight which is equal in weight to the polish rod assembly and one-half the fluid weight).

Thus, when the weight of the counterweight is adjusted to be equal to the weight of the polish rod assembly and one-half of the fluid contained in the polish rod assembly, then the maximum energy needed to operate the system is one-half of the fluid weight.

By adjusting the counterweight in this manner, the pumping unit operates on the minimum amount of energy such that the volume of crude oil pumped per unit is maximized. This, of course, renders these pumping units more economical than any previously known pumping units.

FIG. 5 is a further simplified schematic view of the well pump assembly illustrated in FIG. 1 with the fourth sheave set 96 omitted for clarity.

Once given the above disclosure, many other embodiments, modifications and improvements to this invention will become apparent to those skilled in the art. Such other embodiments, modifications or improvements are considered to be within the scope of this invention as defined by the following claims.

What is claimed is:

1. A well pumping unit comprising:

a derrick;

a polish rod assembly;

drive means for operating said well pumping unit;

a counterweight;

first and second sheave assemblies, said sheave assemblies being rotatably connected to said derrick near the top of said derrick in a spaced relationship; and cable means for connecting said drive means, said polish rod assembly and said counterweight;

said cable means engaging said sheaves, said counterweight being suspended by said cable means between said sheave assemblies, wherein said cable means forms a closed loop extending from said polish rod assembly to said first sheave assembly, to said counterweight, to said second sheave assembly, to said drive mechanism, to said second sheave assembly, to said first sheave assembly and back to said polish rod assembly.

2. A well pumping unit according to claim 1, wherein said polish rod assembly is located on one side of said derrick, said counterweight is located within said derrick and said drive mechanism is located on the side of said derrick opposite said polish rod assembly.

3. A well pumping unit according to claim 1, wherein said counterweight has removeable members so that the weight of said counterweight may be adjusted.

4. A well pumping unit according to claim 1, wherein said drive means is a reciprocating drive mechanism.

5. A well pumping unit according to claim 4, wherein said cable means is fixedly attached to said drive mechanism.

6. A well pumping unit according to claim 5, wherein said drive mechanism and said cable means function to lift said polish rod assembly when said drive mechanism moves in one direction and to lift said counterweight when said drive mechanism moves in the opposite direction.

7. A well pumping unit according to claim 1, and further comprising a third sheave, said third sheave assembly being positioned adjacent said drive means, said cable means engaging said third sheave assembly.

8. A well pumping unit according to claim 7, wherein said cable means forms a closed loop extending from said polish rod assembly to said first sheave assembly, to said counterweight, to said second sheave assembly, to said third sheave assembly, to said drive mechanism, to said third sheave, to said second sheave assembly, to said first sheave assembly, and back to said polish rod assembly.

9. A well pumping unit according to claim 1, and further comprising a moveable sled, said derrick and said drive mechanism being mounted on said sled.

10. A well pumping unit according to claim 1, wherein said cable means includes two cables, each of said cables forming said closed loop.

11. A well pumping unit according to claim 1, wherein the drive mechanism includes a reciprocating drum, said cable means being attached to said reciprocating drum.

12. A well pumping unit according to claim 11, wherein when said reciprocating drum rotates in one direction, said drum and said cable means lifts said polish rod assembly and when said drum rotates in the other direction, said drum and said cable means lifts said counterweight.

13. A well pumping unit comprising:

a derrick structure including first and second sheave assemblies, having rotatable sheaves, located near the top of said derrick structure;

a polish rod assembly;

a drive mechanism including a reciprocating drum;

a counterweight;

cable means for connecting said counterweight, said polish rod assembly and said drum, said cable means engaging said sheave assemblies;

said counterweight being supported by said cable means between said sheave assemblies;

said cable means forming a closed loop extending from said polish rod assembly to said first sheave assembly to said counterweight, to said second sheave assembly, to said reciprocating drum, to said second sheave assembly, to said first sheave assembly and back to said polish rod assembly.

14. A well pumping unit according to claim 13, wherein said polish rod assembly is located on a first side of said derrick structure, said counterweight is located within said derrick structure and said drive mechanism is located on a second side of the derrick structure.

15. A well pumping unit according to claim 13, wherein said counterweight is located in said derrick structure and said polish rod and said drive mechanism are located outside said derrick structure.

16. A well pumping unit according to claim 13, wherein said cable means is a single cable forming said closed loop.

17. A well pumping unit according to claim 16, wherein said cable is attached to said reciprocating drum.

18. A well pumping unit according to claim 13, wherein said cable means includes two cables, each of said cables forming said closed loop.

* * * * *